US008531383B2

(12) United States Patent
Toshima et al.

(10) Patent No.: US 8,531,383 B2
(45) Date of Patent: Sep. 10, 2013

(54) DISPLAY DEVICE WITH LUMINANCE VARIATION CONTROL UNIT

(75) Inventors: Goki Toshima, Tachikawa (JP); Junichi Maruyama, Yokohama (JP); Koji Hosogi, Hiratsuka (JP); Misa Owa, Kokubunji (JP); Kikuo Ono, Mobara (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 586 days.

(21) Appl. No.: 12/759,068

(22) Filed: Apr. 13, 2010

(65) Prior Publication Data

US 2010/0265405 A1 Oct. 21, 2010

(30) Foreign Application Priority Data

Apr. 17, 2009 (JP) ..... 2009-101137

(51) Int. Cl.
*G09G 3/36* (2006.01)

(52) U.S. Cl.
USPC ..... 345/102

(58) Field of Classification Search
USPC ..... 345/82, 83, 102
See application file for complete search history.

(56) References Cited

U.S. PATENT DOCUMENTS

| | | | | |
|---|---|---|---|---|
| 2007/0063961 | A1 | 3/2007 | Kuroki | |
| 2008/0123987 | A1 * | 5/2008 | Shen et al. | 382/255 |
| 2008/0143757 | A1 * | 6/2008 | Furihata et al. | 345/102 |
| 2008/0284719 | A1 * | 11/2008 | Yoshida | 345/102 |
| 2008/0297464 | A1 | 12/2008 | Ito | |
| 2010/0002009 | A1 * | 1/2010 | Takata | 345/102 |
| 2011/0298839 | A1 | 12/2011 | Nakanishi | |
| 2012/0256818 | A1 | 10/2012 | Kuroki | |

FOREIGN PATENT DOCUMENTS

| | | |
|---|---|---|
| JP | 2001-142409 | 5/2001 |
| JP | 2008-299145 | 12/2008 |
| WO | WO 2007072598 A1 * | 6/2007 |

* cited by examiner

*Primary Examiner* — Allison Walthall
(74) *Attorney, Agent, or Firm* — Antonelli, Terry, Stout & Kraus, LLP.

(57) ABSTRACT

Provided is a display device capable of producing an image of excellent quality with reduced flicker and little reduction in luminance, the display device including: a backlight having light sources such as LED devices arranged two-dimensionally, each of which may be individually modulated in luminance; a moving velocity detection unit VD1 (109) for detecting a moving velocity of an object in a video (for example, moving velocity of a foreground); and a luminance variation control unit (113) for automatically controlling luminance variations of the LED devices for each frame, in accordance with the moving velocity.

5 Claims, 8 Drawing Sheets

FIG.8A
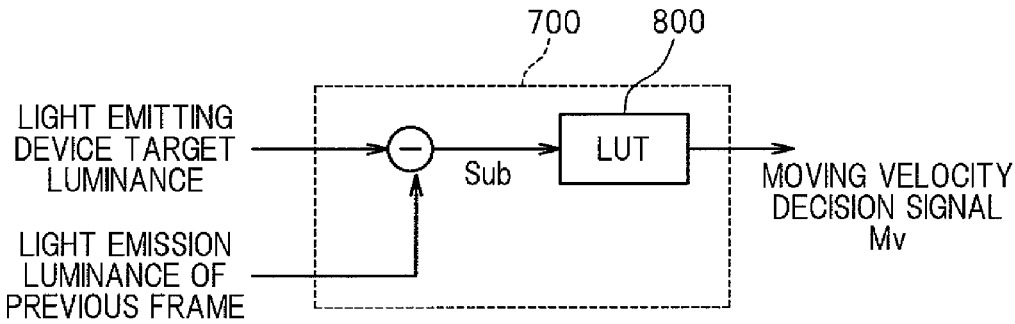
FIG.8B
| | Sub≧ REFERENCE VALUE Su | Sub< REFERENCE VALUE Su |
|---|---|---|
| MOVING VELOCITY DECISION SIGNAL Mv | 1 ( DETERMINED AS HIGH VELOCITY ) | 0 ( DETERMINED AS LOW VELOCITY ) |
FIG.9
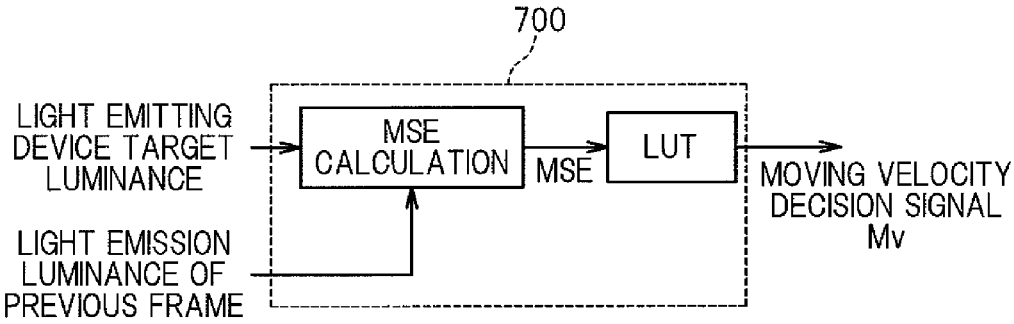

DISPLAY DEVICE WITH LUMINANCE VARIATION CONTROL UNIT

CROSS-REFERENCE TO RELATED APPLICATION

The present application claims priority from Japanese application JP2009-101137 filed on Apr. 17, 2009, the content of which is hereby incorporated by reference into this application.

BACKGROUND OF THE INVENTION

1. Field of the Invention

The present invention relates to a display device, and more particularly, to a display device suited to displaying a moving image.

2. Description of the Related Art

Heretofore, a backlight using a cold cathode fluorescent lamp (CCFL) has been mainly used for a backlight of a liquid crystal display device. However, in recent years, further research has been conducted on a backlight using a light emitting diode (LED) device. JP 2001-142409 A (hereinafter, referred to as Patent Document 1) discloses a representative example of such a backlight using an LED device.

Patent Document 1 discloses the following method. At least one LED, which serves as a light source for emitting illuminating light irradiating a liquid crystal panel, is arranged for each of a plurality of divided areas. The LED is controlled in the unit of divided areas so as to irradiate at least only an area requiring the illuminating light, in accordance with an image to be displayed. An area which does not require the illuminating light is not irradiated basically. In this manner, the power consumption required for illumination may be reduced.

According to the technology disclosed in Patent Document 1, the LED devices vary in light emission luminance for each divided display area, and the variation in light emission luminance results in flicker. One of the representative exemplary methods to solve the problem is disclosed in JP 2008-299145 A (hereinafter, referred to as Patent Document 2).

Patent Document 2 relates to a technology of controlling LEDs. According to the technology, it is determined whether an input video is a still image or a moving image, and in the case where the input video is a still image, the LED devices are constantly turned on, to thereby avoid flicker.

SUMMARY OF THE INVENTION

The technology disclosed in Patent Document 2 aims to avoid flicker in a still image, and hence there may be expected no effect therefrom of avoiding flicker in a moving image.

Under the circumstances, the inventors of the present invention have made a study on a method of controlling LEDs so as to avoid flicker even in displaying a moving image. In the course of the study, the inventors have discovered that flicker becomes more noticeable in a display where an object in the video moves at lower velocity (for example, a display in which the foreground scrolls at lower velocity), while luminance substantially reduces in a display in which an object in the video moves at higher velocity (for example, a display in which the foreground scrolls at higher velocity).

It is an object of the present invention to provide a display device capable of producing an image of excellent quality with reduced flicker and little reduction in luminance, the display device including a backlight having a plurality of light sources (for example, a plurality of LED devices) arranged two-dimensionally, each of which may be individually modulated in luminance.

The display device according to the present invention, which includes the backlight having the plurality of light sources (for example, the plurality of LED devices) arranged two-dimensionally, and is capable of modulating the luminance for each light source, further includes means for detecting a moving velocity of an object in a video (for example, moving velocity of a foreground), and means for automatically controlling luminance variations of the light sources for each light source, in accordance with the moving velocity of the object in the video.

The present invention may thus provide the display device, which includes the backlight having the plurality of light sources (for example, the plurality of LED devices) arranged two-dimensionally, each of which may be individually modulated in luminance, and which is capable of producing an image of excellent quality with reduced flicker and little reduction in luminance.

BRIEF DESCRIPTION OF THE DRAWINGS

In the accompanying drawings:

FIG. 8A is a diagram illustrating a first configuration example of a moving velocity detection unit according to the third embodiment;

FIG. 8B is a diagram illustrating the first configuration example of the moving velocity detection unit according to the third embodiment; and FIG. 9 is diagram illustrating a second configuration example of the moving velocity detection unit according to the third embodiment.

DETAILED DESCRIPTION OF THE INVENTION

Subsequently, examples of a configuration of a display device according to the present invention are described.

[First Embodiment]

A first embodiment of the present invention is described with reference to FIGS. 1 to 3.

In the display device according to the first embodiment, it is detected whether a display in which an object in a video corresponding to an input video moves at higher velocity (for example, a display in which the foreground moves at higher velocity) is provided or a display in which the object moves at lower velocity (for example, a display in which the foreground moves at lower velocity) is provided, and the luminance variations in one frame of the LED devices forming a backlight is automatically controlled for each LED device according to the detection result.

Figure 1:
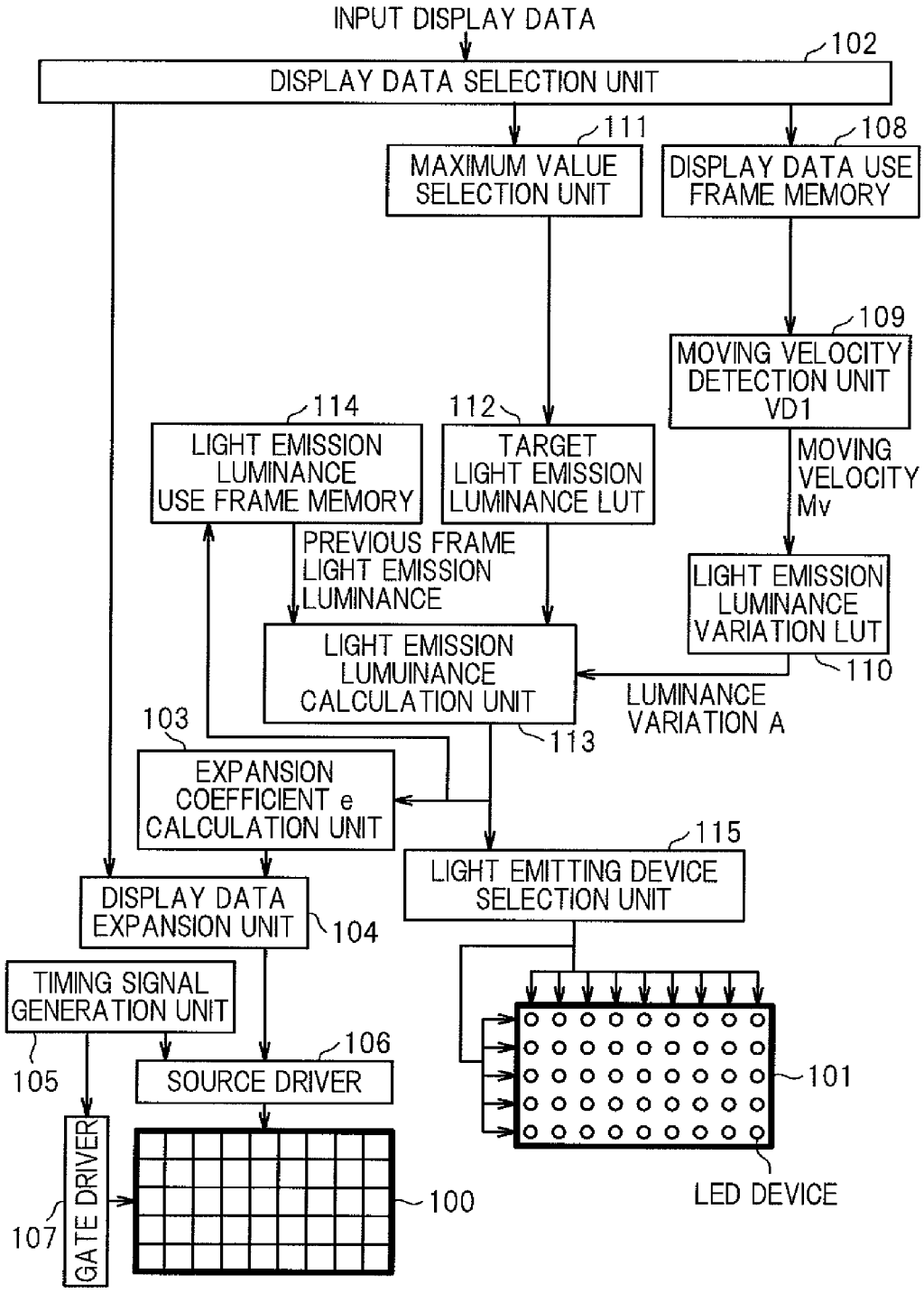
FIG. 1 is a diagram illustrating a display device according to a first embodiment of the present invention.
Figure 2:
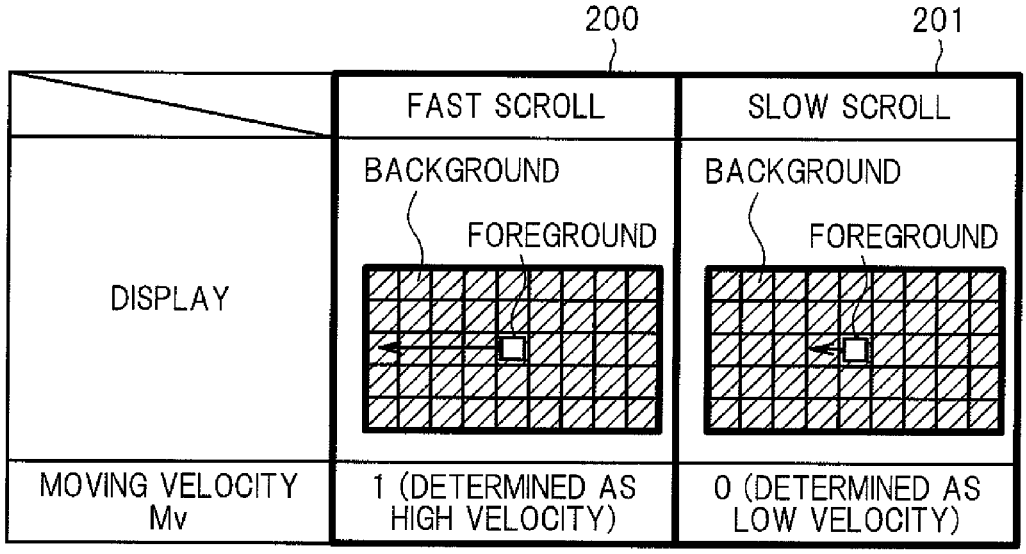
FIG. 2 is a diagram for illustrating a moving velocity of an object in a video according to the first embodiment.

FIG. 1 is a diagram illustrating an example of the liquid crystal display device according to the first embodiment.

A display panel 100 includes, for example, a liquid crystal display panel in which display elements are arranged as pixels (display units) in a matrix of S columns and T rows (S and T each are an integer equal to or larger than 2). In the display panel 100, each of the pixels are applied with a gradation voltage so that the pixels are individually controlled in transmittance (modulation degree of light passing through the liquid crystal).

A backlight 101 serves a function of illuminating the display panel 100, and has a plurality of light sources. Each of the light sources may employ, for example, a cold cathode fluorescent lamp (CCFL), a hot cathode fluorescent lamp (HCFL), or a light emitting diode (LED) device. In the backlight 101, a plurality of illumination areas are arranged in P columns and Q rows, and the luminance and turn-on/turn-off timing of the light sources may be controlled for each of the illumination areas (P and Q each are an integer equal to or larger than 2. FIG. 1 illustrates an exemplary case where LEDs are used for the backlight 101 and P=9 and Q=5).

In the display device, a display luminance to be finally obtained for each pixel may be determined by multiplying a transmittance of each pixel of the display panel 100 with a luminance of each area of the backlight 101 corresponding to the pixel.

The gradation voltage to be applied to the display panel 100 may be controlled by blocks 102 to 107 described below.

The display data selection unit 102 is a block for sequentially selecting input display data for each area of the display panel 100, and transferring the display data to a display data expansion unit 104, a maximum value selection unit 111, and display data use frame memory 108, which are described later.

An expansion coefficient calculation unit 103 is a block for calculating an expansion coefficient e (e is a value equal to or larger than 1) for use in expanding display data, in accordance with an LED light emission luminance data value transferred from a light emission luminance calculation unit 113 to be described later, and transferring the expansion coefficient e to the display data expansion unit 104 to be described later.

The display data expansion unit 104 is a block for multiplying the expansion coefficient e transferred from the expansion coefficient calculation unit 103 with display data transferred from the display data selection unit 102, and transferring the result to a source driver 106 to be described later.

With the use of the expansion coefficient calculation unit 103 and the data display expansion unit 104, the power consumption and flicker may be reduced.

For example, a case is assumed where a certain luminance B1 is displayed under a reference state where the backlight 101 has a luminance B11 and a display panel has a transmittance Tr1. In this case, a relation of B1=B11×Tr1 is established. Meanwhile, the expansion coefficient calculation unit 103 and the display data expansion unit 104 reduce a luminance of the backlight to 1/e of the reference state while expanding the display data so that the transmittance of the display panel is increased e times larger than usual. The luminance observed in this case is obtained as B2=(B11×1/e)×(Tr1×e). In other words, when the transmittance Tr1 is expanded, an observation luminance obtained with a smaller backlight luminance B12 becomes equal to the observation luminance obtained with a backlight luminance B11 in the reference state (that is, B1=B2 is attained).

Further, even if the luminance of the backlight varies, the observation luminance is maintained, which may alleviate flicker resulting from a variation in the backlight luminance.

A timing signal generation unit 105 is a block for generating a timing signal to be used by the source driver 106 and a gate driver 107, and transferring the timing signal to the source driver 106 and the gate driver 107.

The source driver 106 is a block for selecting, according to the timing signal transferred from the timing signal generation unit 105, a gradation voltage appropriate to display data which has been subjected to expansion calculation and transferred from the display data expansion unit 104, and applying the gradation voltage to the pixels of the display panel 100 in accordance with the timing signal transferred from the gate driver 107.

The gate driver 107 is a block for generating, in accordance with the timing signal transferred from the timing signal generation unit 105, a timing signal indicating a timing at which the source driver 106 applies the gradation voltage to the pixels of the display panel 100.

The LED devices of the backlight 101 may be controlled in light emission luminance by blocks 108 to 115 described below.

The display data use frame memory 108 is a block for holding display data for the past N frames transferred from the display data selection unit 102, and transferring the display data to a moving velocity detection unit VD1 109 to be described later.

The moving velocity detection unit VD1 109 is a block for detecting a moving velocity (for example, a velocity at which the foreground scrolls) by calculating a luminance histogram or a motion vector based on the display data transferred from the display data use frame memory 108, and transferring the moving velocity (Mv) to a light emission luminance variation LUT 110 to be described later. Specifically, the moving velocity detection unit VD1 109 outputs the moving velocity (Mv) =1 for a display 200 illustrated in FIG. 2 where a bright foreground moves at higher velocity in a dark background, while outputs the moving velocity (Mv)=0 for a display 201 illustrated in FIG. 2 where a bright foreground moves at lower velocity in a dark background.

It should be noted that, in the first embodiment, the method of detecting a moving velocity employs, for example, a luminance histogram or a motion vector. However, any other method may also be employed as long as the method is capable of detecting a moving velocity. Further, the moving velocity is detected at two stages of high velocity and low velocity, which may also be detected at H stages (H is equal to or larger than 3).

The light emission luminance variation LUT 110 is a block provided with a look-up table (LUT) storing a luminance variation per one frame when the light emission luminance of LED devices forming the backlight 101 increases or decreases, for selecting a luminance variation (A) from the look-up table (LUT) in accordance with the moving velocity (Mv) transferred from the moving velocity detection unit VD1 109, and transferring the luminance variation (A) to a light emission luminance calculation unit 113 to be described later.

Figure 3A:
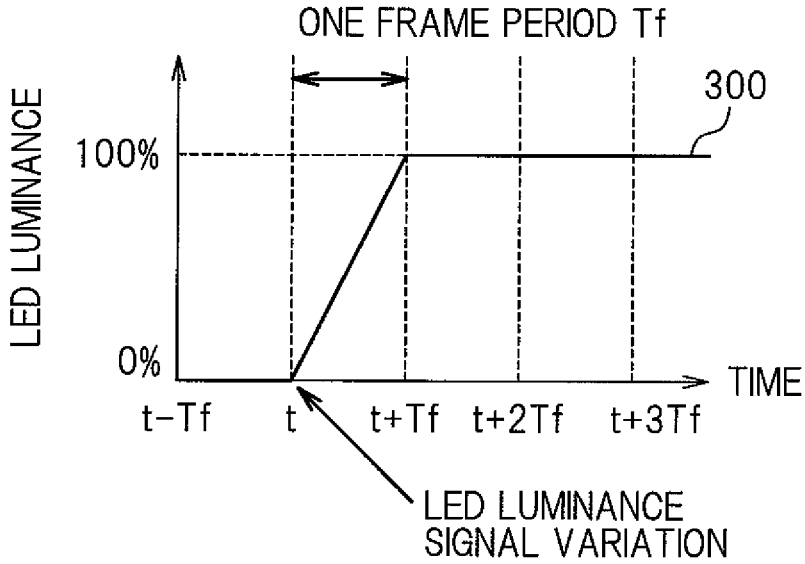
FIG. 3A is a graph illustrating a relation between the moving velocity of an object in a video and a luminance variation of a backlight LED according to the first embodiment.
Figure 3B:
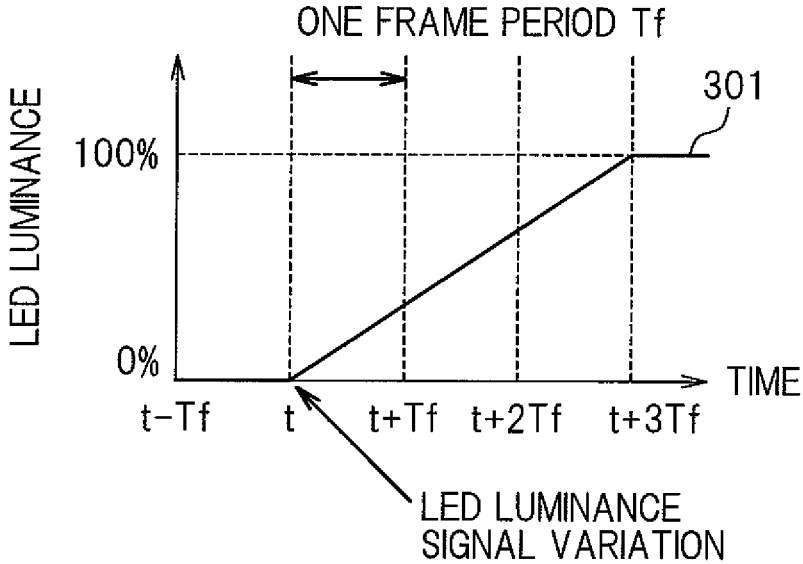
FIG. 3B is a graph illustrating a relation between the moving velocity of an object in a video and the luminance variation of the backlight LED according to the first embodiment.

For example, when a moving velocity (Mv) is 1, a large luminance variation is selected. In this case, the light emission luminance 300 of the LED devices forming the backlight 101 precipitously increases to reach a target luminance as illustrated in FIG. 3A. As illustrated in FIG. 3A, the luminance 300 of the LED devices changes from 0% to 100% in one frame period, and therefore the luminance variation per one frame is 100%. On the other hand, when the moving velocity (Mv) is 0, a small luminance variation is selected. In this case, the light emission luminance 301 of the LED devices forming the backlight 101 gradually reaches a target value as illustrated in FIG. 3B. As illustrated in FIG. 3B, the luminance 301 of the LED devices changes from 0% to 100% over three frame periods, and therefore the luminance variation per one frame is 33.3%.

It should be noted that in the first embodiment, the luminance variation is defined by two stages including cases of a sudden change and a gradual change. However, the luminance variation may be defined by L stages (L is equal to or larger than 3).

Further, values stored in the look-up table (LUT) may be changed by a register adjustable from outside. Further, the number of smaller values stored in the look-up table (LUT) may preferably be larger than the number of larger values stored therein. With this configuration, in the case of a low velocity movement display, a luminance variation (A) may be selected with higher accuracy, with the result that flicker in the low velocity movement display may be avoided with more ease.

The maximum value selection unit 111 is a block for selecting a maximum value from the display data transferred from the display data selection unit 102, and transferring the maximum value to a target light emission luminance LUT 112 to be described later.

The target light emission luminance LUT 112 is a block provided with a look-up table storing luminance values of light emitting devices, for selecting a target light emission luminance from the look-up table in accordance with the data transferred from the maximum value selection unit 111, and transferring the target light emission luminance to a light emission luminance calculation unit 113 to be described later.

The light emission luminance calculation unit 113 is a block for comparing the target light emission luminance transferred from the target light emission luminance LUT 112 with a previous frame light emission luminance transferred from a light emission luminance use frame memory 114 to be described later, calculating, based on the comparison result, a light emission luminance, and transferring the light emission luminance to the expansion coefficient e calculation unit 103, to the light emission luminance use frame memory 114 to be described later, and to a light emitting device selection unit 115 to be described later. A specific process of calculating the light emission luminance is as follows. When the target light emission luminance value is larger than the light emission luminance value of the previous frame, the luminance variation (A) transferred from the light emission luminance variation LUT 110 is added to the light emission luminance value of the previous frame. When the target light emission luminance value is smaller than the light emission luminance value of the previous frame, the luminance variation (A) is subtracted from the light emission luminance value of the previous frame. In the manner as described above, the light emission luminance calculation unit 113 controls the luminance variation for each light emitting device in accordance with the result detected by the moving velocity detection unit VD1 109.

The light emission luminance use frame memory 114 is a block for transferring the luminance data value transferred from the light emission luminance calculation unit 113, to the light emission luminance calculation unit 113, after holding the luminance data value for one frame period.

The light emitting device selection unit 115 is a block for applying a voltage corresponding to the light emission luminance, to the light emitting devices forming the backlight 101, under the control of the light emission luminance calculation unit 113.

In the above, the first embodiment has been described in detail. The display device according to the first embodiment includes the backlight 101 having a plurality of light sources and is capable of controlling a luminance for each light source, and the display device may further include the moving velocity detection unit VD1 109 for detecting a moving velocity of an object in a video and a luminance variation control unit (corresponding to the light emission luminance variation LUT 110 and the light emission luminance calculation unit 113 of FIG. 1) for controlling a luminance variation of each of the light sources in accordance with the result detected by the moving velocity detection unit VD1 109. The luminance variation control unit sets, for example, the luminance variation to a first value when the moving velocity of an object in a video is high, while sets the luminance variation to a second value when the moving velocity of an object in a video is low. Here, the first value is larger than the second value. In the examples of FIGS. 3A and 3B, the first value is 100% and the second value is 33.3%. Further, when the second value may be adjustable in smaller units as compared with the first value, the luminance variation in a low velocity movement display may be selected with higher accuracy, with the result that flicker in a low velocity movement display may be avoided with more ease.

According to the first embodiment of the present invention, a moving velocity of an object in a video may be detected, and luminance variations of the LED devices may be adjusted in accordance with the moving velocity, to thereby obtain a display in excellent quality with reduced flicker and little reduction in luminance in displaying the video.

Specifically, in a case of a display in which an object in a video moves at lower velocity (for example, a display in which the foreground moves at lower velocity), the luminance variations in the LED devices may be controlled to be small so as to gradually increase or decrease the luminance, to thereby obtain a display in excellent quality with reduced flicker.

On the other hand, in a case of a display in which an object in a video moves at higher velocity (for example, a display in which the foreground moves at higher velocity), the luminance variations in the LED devices may be controlled to be large so as to precipitously increase or decrease the luminance, to thereby obtain a display in excellent quality with little reduction in luminance.

[Second Embodiment]

Figure 4A:
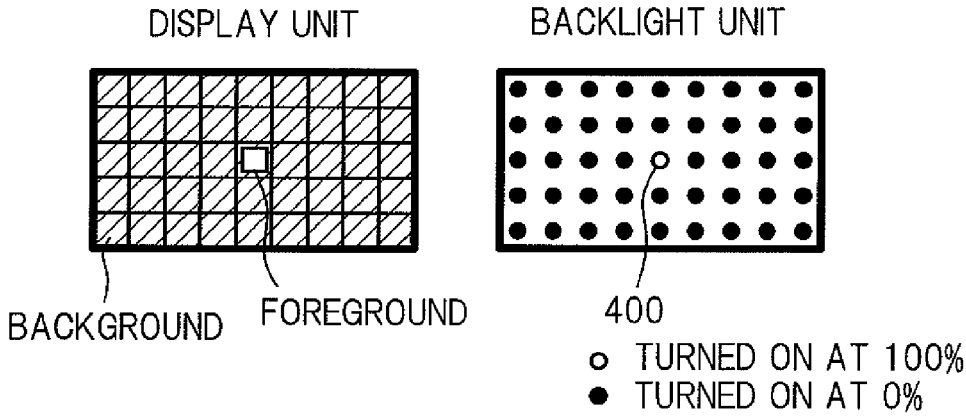
FIG. 4A is a diagram for illustrating an LED lighting pattern in a backlight according to a second embodiment of the present invention.
Figure 4B:
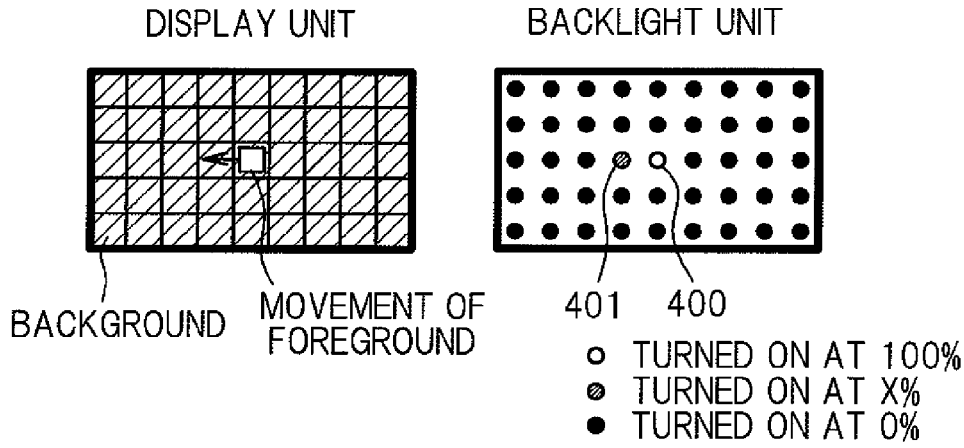
FIG. 4B is a diagram for illustrating another LED lighting pattern in the backlight according to the second embodiment.
Figure 4C:
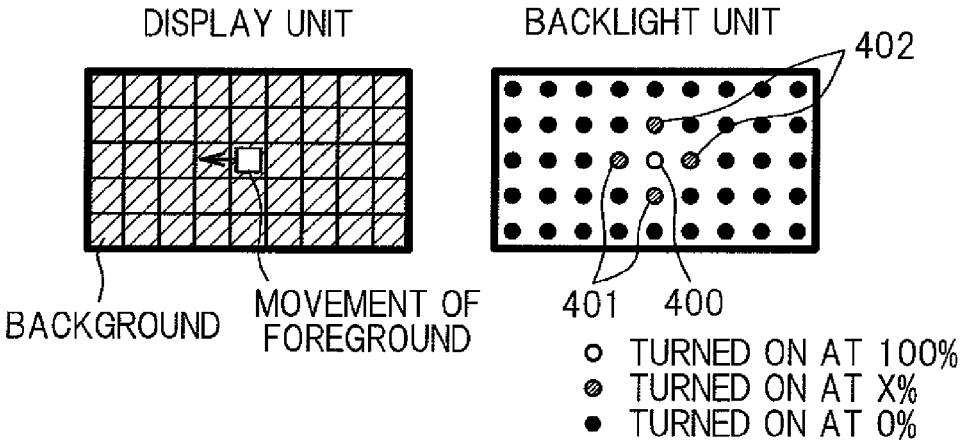
FIG. 4C is a diagram for illustrating further another LED lighting pattern in the backlight according to the second embodiment.

A second embodiment of the present invention is described with reference to FIGS. 4 and 5. In the first embodiment, when a displayed object in a video moves at lower velocity, the luminance variation of the LED backlight is controlled to be small, which has a negative side that it takes time for the LED backlight to reach a target luminance, with the result that the display luminance reduces until the target luminance is reached. In order to work around the problem, in a display device according to the second embodiment, a move destination of a display object is estimated, and the LED luminance in the area of the move destination is increased in advance to around the target value. In other words, as compared with the display device according to the first embodiment in which only an LED 400 for irradiating a foreground is turned on as illustrated in FIG. 4A, in the display device according to the second embodiment, the luminance of an LED 401 in the moving direction of the foreground is increased in advance as illustrated in FIG. 4B. FIG. 4B illustrates an example where the LED 400 is turned on at 100% and the LED 401 is turned on at X %. X is defined as 0<X<100. Alternatively, as illustrated in FIG. 4C, LEDs 402 surrounding the LED 400 may all be increased in luminance so as to cover any moving direction to the right, left, upward, or downward. FIG. 4C illustrates an example where the LED 400 is turned on at 100% while the LEDs 401 and 402 are turned on at X %.

Figure 5:
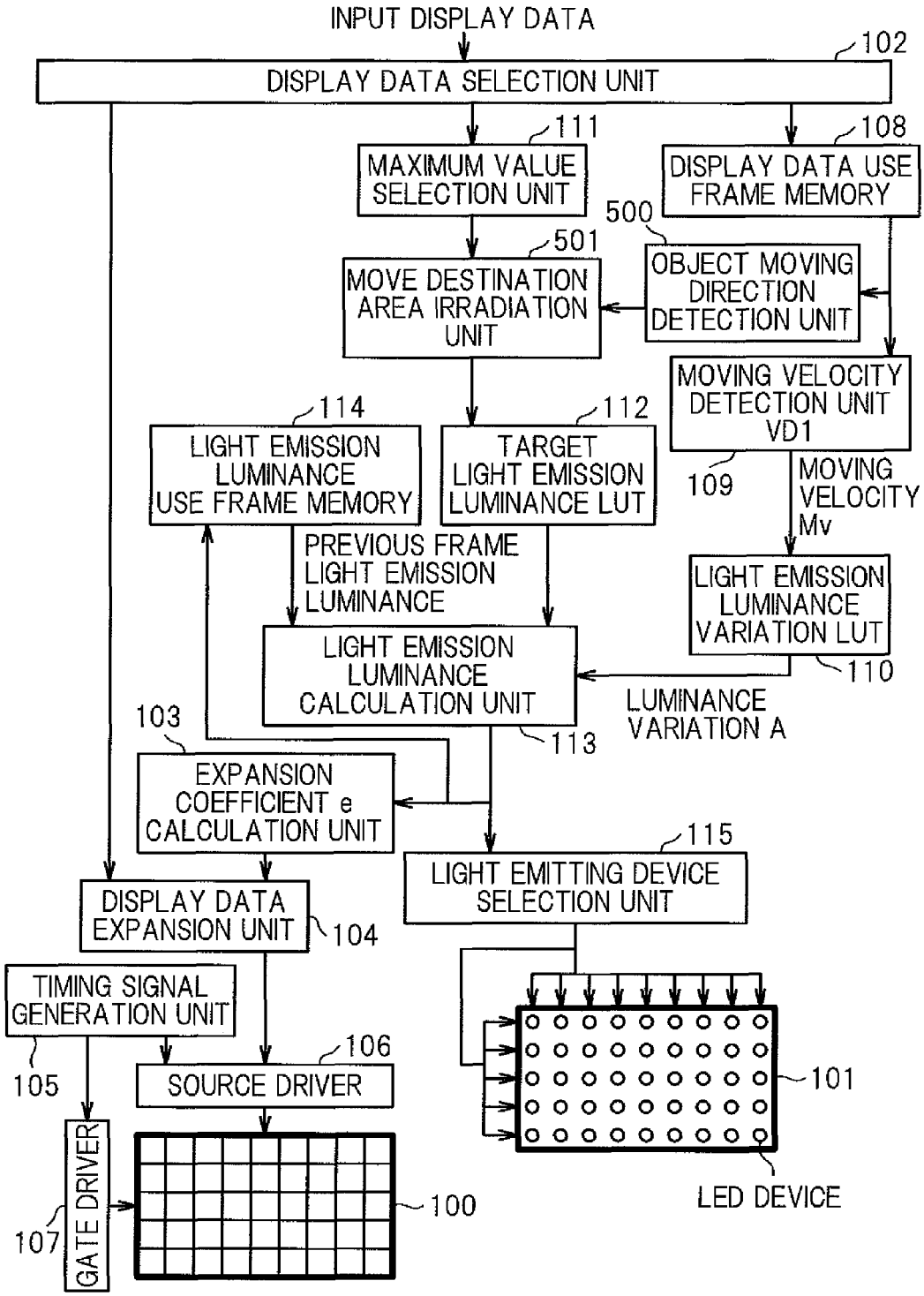
FIG. 5 is a diagram illustrating a display device according to the second embodiment.

FIG. 5 is a diagram illustrating an example of the display device according to the second embodiment. As illustrated in FIG. 5, the display device includes the constituent elements 100 to 115 similarly to the first embodiment. The display device according to the second embodiment further includes an object moving direction detection unit 500 and the move destination area irradiation computing unit 501.

The object moving direction detection unit 500 is a block for detecting, based on data for a plurality of frames input from the display data use frame memory 108, a move destination direction, and transferring a signal indicating any one of upward, downward, rightward, leftward, and diagonal directions, to the move destination area irradiation computing unit 501. The moving direction may be detected by using an optical flow or the like which is generally employed in a video processing technology. However, any other method may be employed, without being limited to the method, as long as the method is capable of detecting or estimating the moving direction.

The move destination area irradiation computing unit 501 is a block for performing a computation on the data transferred from the maximum value selection unit 111, based on the signal from the object moving direction detection unit 500, so as to irradiate the moving direction of the moving object, and transferring the data obtained from the computation to the target light emission luminance LUT 112.

In the case where the LEDs of the adjacent areas are all increased in luminance beforehand as illustrated FIG. 4C, the object moving direction detection unit 500 may be omitted. The move destination area irradiation computing unit 501 may perform a computation so as to increase in advance the luminances of the LEDs of all the adjacent areas.

In the above, the second embodiment has been described in detail. The display device according to the second embodiment may include, in addition to the configuration of the first embodiment, an adjacent area irradiation computing unit (corresponding to the move destination area irradiation computing unit 501 of FIG. 5) for computing luminances of the light sources in at least one or all areas adjacent in upward, downward, rightward, leftward, and diagonal directions to the display area of an object in a video, so that the at least one or all adjacent areas may be irradiated in advance, in which a luminance variation control unit (corresponding to the light emission luminance calculation unit 113 of FIG. 5) controls, as well as controlling the luminance variation of the light sources of the display area in accordance with the result detected in the moving velocity detection unit VD1 109, the luminances of the light sources in the adjacent areas in accordance with the result of a computation performed by the adjacent area irradiation computing unit. Further, the display device according to the second embodiment further includes the object moving direction detection unit 500 for detecting a moving direction of an object in a video, in which the adjacent area irradiation computing unit (move destination area irradiation computing unit 501) may compute the luminance of a light source in the adjacent area that is the move destination of an object in a video, so that the adjacent area may be irradiated in advance.

According to the second embodiment of the present invention, the negative side of the first embodiment may be alleviated. Specifically, in the first embodiment, it takes time for the LED backlight to reach a target luminance because the luminance variation of the LED backlight is controlled to be small, with the result that the display luminance reduces until the target luminance is reached. According to the second embodiment, however, the move destination of a display object is estimated and the LED luminance in the area of the move destination is increased in advance to around the target value, to thereby suppress the above-mentioned reduction in luminance.

[Third Embodiment]

A third embodiment of the present invention is described with reference to FIGS. 6 to 9. The first embodiment requires the display data use frame memory 108 for determining the moving velocity of an object in an input video, which increases the cost. In view of the above, the third embodiment is capable of producing an effect similar to that of the first embodiment, without the need for the display data use frame memory 108 of the first embodiment.

Figure 6A:
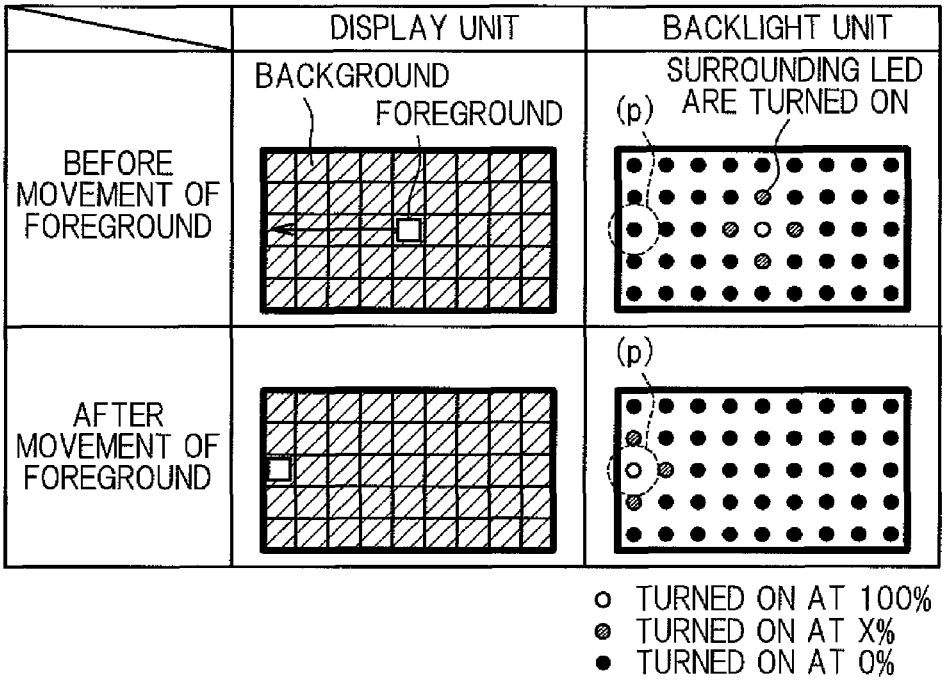
FIG. 6A is a diagram for illustrating an operating principle according to a third embodiment of the present invention.

An operating principle of the third embodiment is described with reference to FIGS. 6A and 6B. FIG. 6A is a diagram illustrating, by taking a display unit in which the foreground moves at higher velocity as an example, a display before and after the movement of the foreground, and a backlight unit in which the LED device corresponding to the foreground is turned on at 100% and LED devices surrounding the LED device are turned on at X %. X is defined as 0<X<100.

Figure 6B:
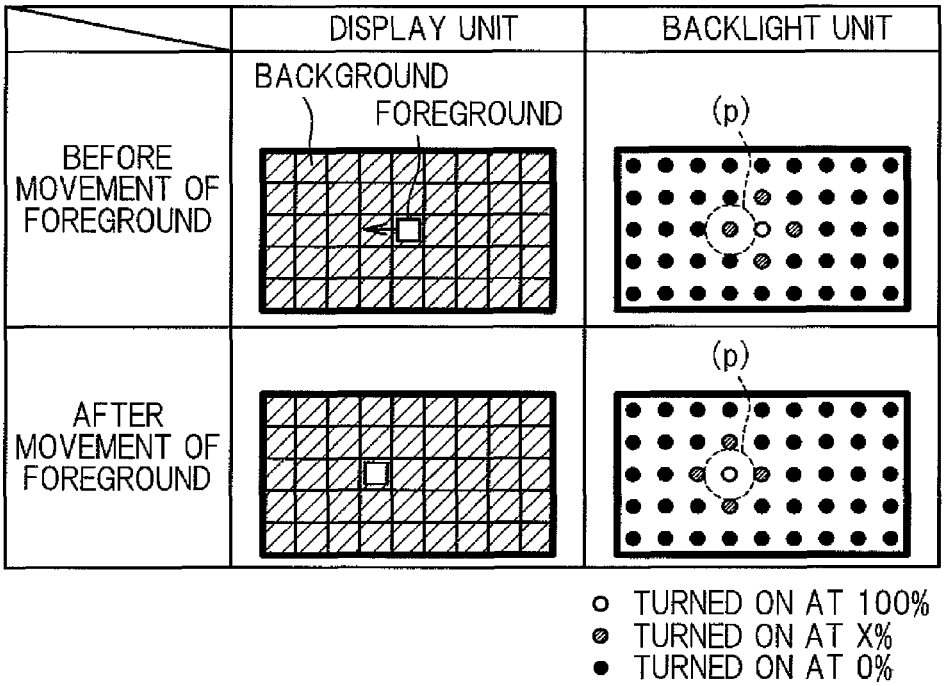
FIG. 6B is a diagram for illustrating the operating principle according to the third embodiment.

FIG. 6B is a diagram illustrating, by taking a display unit in which the foreground moves at lower velocity as an example, a display before and after the movement of the foreground, and a backlight unit in which the LED device corresponding to the foreground is turned on at 100% and LED devices surrounding the LED device are turned on at X %.

In FIG. 6A, the difference in luminance of the LED device (P) before and after the movement of the foreground is 100%, which is (100-X) % in FIG. 6B. The difference in luminance may allow easy determination as to whether the moving velocity of the foreground is low or high.

In other words, the difference between the LED luminance of the previous frame and the LED luminance of the current frame is calculated, and when the difference is large, it is determined that the moving velocity of an object in a video is high in the display (for example, the foreground moves at higher velocity in the display). On the other hand, when the difference is small, it is determined that the moving velocity is low in the display (for example, the foreground moves at lower velocity in the display).

Figure 7:
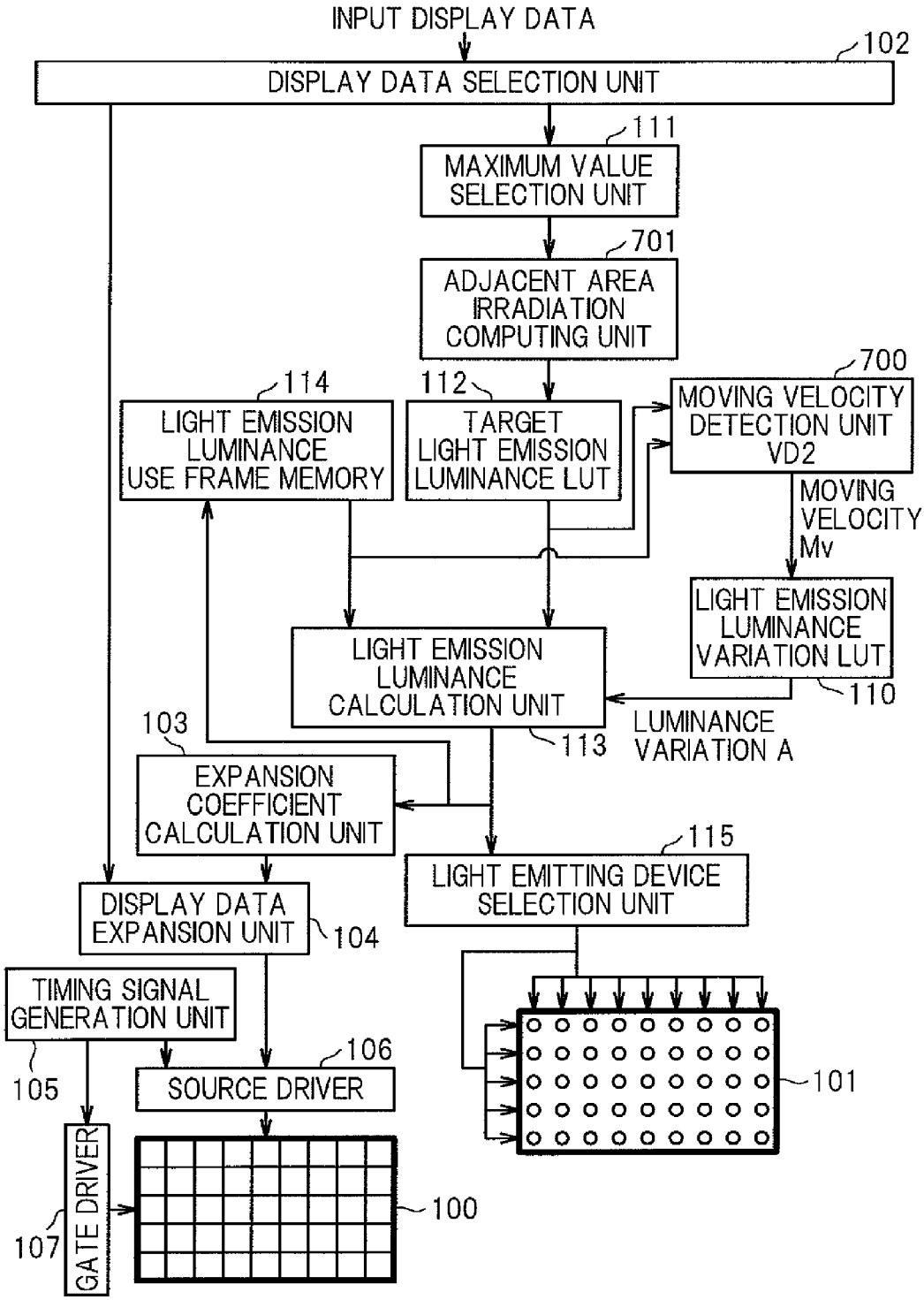
FIG. 7 is a diagram illustrating a display device according to the third embodiment.

FIG. 7 is a diagram illustrating an example of a liquid crystal display device according to the third embodiment. In FIG. 7, the display device includes the constituent elements 100 to 107 and 110 to 115 similarly to the first embodiment. The display device according to the third embodiment includes a moving velocity detection unit VD2 700 in place of the moving velocity detection unit VD1 109, and further includes an adjacent area irradiation computing unit 701.

The moving velocity detection unit VD2 700 is a block for comparing an LED light emission luminance value of the previous frame transferred from the light emission luminance use frame memory 114 with an LED target luminance value of the current frame transferred from the target light emission luminance LUT 112, determining a moving velocity (Mv) based on the difference therebetween, and transferring the moving velocity (Mv) thus determined to the light emission luminance variation LUT 110.

The internal operation of the moving velocity detection unit VD2 700 is described with reference to FIGS. 8A and 8B. FIG. 8A is a block diagram illustrating an inside of the moving velocity detection unit VD2 700. The block includes a circuit for calculating a difference (Sub) between the LED light emission luminance value of the previous frame and the LED target luminance value of the current frame, and an LUT 800 for selecting a moving velocity (Mv) appropriate to the difference (Sub).

An operation of the LUT 800 is described with reference to FIG. 8B. FIG. 8B is a diagram illustrating a relation between the difference (Sub) and the moving velocity (Mv). When the difference (Sub) is larger than an arbitrary reference value Su, the LUT 800 determines that the display is of high velocity and selects a moving velocity Mv of 1. When the difference (Sub) is smaller than the arbitrary reference value Su, the LUT determines that the display is of low velocity and selects a moving velocity Mv of 0.

In the third embodiment, the difference (Sub) between the LED light emission luminance value of the previous frame and the LED target luminance value of the current frame is employed. It should be noted that, however, a mean squared error (MSE) between the LED light emission luminance value of the previous frame and the LED target luminance value of the current frame may be calculated as illustrated in FIG. 9, and the moving velocity My may be selected based on the MSE.

The adjacent area irradiation computing unit 701 is a block for performing a computation on data transferred from the maximum value selection unit 111 so as to turn on LEDs for irradiating the surrounding area, and transferring the data obtained from the computation to the target light emission luminance LUT 112. The adjacent area irradiation computing unit 701 may include an external register capable of changing a range of adjacent areas to be irradiated, so that the range of adjacent areas to be irradiated may be adjusted. Alternatively, the adjacent area irradiation computing unit 701 may include an external register capable of changing a lighting luminance of a light source corresponding to the adjacent area to be irradiated, so that the lighting luminance (value of X) of the light source corresponding to the adjacent area may be adjusted.

In the above, the third embodiment has been described in detail. The display device of the third embodiment includes the backlight 101 having a plurality of light sources and is capable of controlling a luminance for each light source, and the display device may further include the adjacent area irradiation computing unit 701 for computing luminances of the light sources in at least one or all areas adjacent in upward, downward, rightward, leftward, and diagonal directions to the display area of an object in a video, so that the at least one or all adjacent areas may be irradiated in advance, a comparing unit (corresponding to the moving velocity detection unit VD2 700 of FIG. 7) for comparing the light emission luminance value of the previous frame and the light emission luminance value of the display frame, and a luminance variation control unit (light emission luminance variation LUT 110 and the light emission luminance calculation unit 113 of FIG. 7) for controlling, as well as controlling the luminance variation of the light source in the display area based on the comparison result of the comparing unit, the luminances of the light sources in the adjacent areas based on the result of the computation performed by the adjacent area irradiation computing unit 701. Further, for example, the comparing unit calculates a difference or an MSE between the light emission luminance value of the previous frame and the light emission luminance value of the display frame, sets the luminance variation to a third value when the difference or the MSE is large, and sets the luminance variation to a fourth value when the difference or the MSE is small. Here, the third value is larger than the fourth value. A register capable of externally adjusting the third value and the fourth value may also be provided. Further, when the fourth value may be made adjustable in smaller units as compared with the third value, the luminance variation in a low velocity movement display may be selected with higher accuracy, with the result that flicker in a low velocity movement display may be avoided with more ease.

According to third embodiment of the present invention, the moving velocity of an object in a video may be detected similarly to the first embodiment and the second embodiment, without the need for a complicated circuit for a motion vector analysis or a histogram analysis on display data, and hence the detection may be performed at low cost.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device for receiving input data of a video and displaying the video, comprising:

a display panel having a plurality of pixels arranged therein for displaying the video;

a backlight for irradiating the display panel, the backlight including a plurality of light sources and being controllable in luminance for each of the plurality of light sources;

a moving velocity detection unit for detecting a moving velocity of an object in the video;

a luminance variation control unit for controlling, for each of the plurality of light sources, a luminance variation of the light source in accordance with the moving velocity detected by the moving velocity detection unit;

an adjacent area irradiation computing unit for computing a luminance of a light source of at least one or all areas adjacent in upward, downward, rightward, leftward, and diagonal directions to a display area for displaying the object in the video, so that the at least one or all adjacent areas are irradiated in advance;

wherein the luminance variation control unit controls, as well as controlling the luminance variation of the light source in the display area in accordance with the moving velocity detected by the moving velocity detection unit, the luminances of the light sources in the adjacent areas in accordance with the luminance computed by the adjacent area irradiation computing unit; and an object moving direction detection unit for detecting a moving direction of the object in the video;

wherein the adjacent area irradiation computing unit computes a luminance of a light source in an adjacent area that is a move destination of the object in the video, so that the adjacent area is irradiated in advance.

2. The display device according to claim 1, wherein the luminance variation control unit sets the luminance variation to a first value in a case where the moving velocity of the object in the video is high, and sets the luminance variation to a second value in a case where the moving velocity of the object in the video is low.

3. The display device according to claim 2, wherein the first value is larger than the second value.

4. The display device according to claim 3, further comprising a register capable of externally adjusting the first value and the second value.

5. The display device according to claim 4, wherein the second value is adjustable in smaller units as compared with the first value.

* * * * *